US008746816B2

(12) United States Patent
Westwinkel

(10) Patent No.: US 8,746,816 B2
(45) Date of Patent: Jun. 10, 2014

(54) TAMPER RESISTANT MODULAR ANTI-TIP LOCKING SYSTEM

(71) Applicant: Wesko Systems Limited, Mississauga (CA)

(72) Inventor: Florian Westwinkel, Toronto (CA)

(73) Assignee: Wesko Systems Limited, Mississauga, Ontario (CA)

( * ) Notice: Subject to any disclaimer, the term of this patent is extended or adjusted under 35 U.S.C. 154(b) by 0 days.

(21) Appl. No.: 13/666,453

(22) Filed: Nov. 1, 2012

(65) Prior Publication Data

US 2014/0103786 A1 Apr. 17, 2014

(30) Foreign Application Priority Data

Oct. 12, 2012 (CA) ..... 02792324

(51) Int. Cl.
*E05B 65/46* (2006.01)

(52) U.S. Cl.
USPC ..... 312/217; 312/220

(58) Field of Classification Search
USPC ..... 312/216, 217, 218, 219, 220, 221, 222, 312/215, 295, 107.5
See application file for complete search history.

(56) References Cited

U.S. PATENT DOCUMENTS

| | | | | |
|---|---|---|---|---|
| 5,702,167 | A * | 12/1997 | Muller | 312/221 |
| 6,109,708 | A * | 8/2000 | Walla et al. | 312/216 |
| 6,450,596 | B1 * | 9/2002 | Lee | 312/217 |
| 6,550,876 | B2 * | 4/2003 | Lammens | 312/217 |
| 6,932,445 | B2 * | 8/2005 | Chiu | 312/221 |
| 7,320,507 | B2 * | 1/2008 | White et al. | 312/221 |
| 7,520,576 | B2 * | 4/2009 | Ludwig et al. | 312/221 |
| 8,220,879 | B2 * | 7/2012 | Chen et al. | 312/221 |
| 8,277,000 | B2 * | 10/2012 | Huang | 312/221 |
| 8,371,664 | B1 * | 2/2013 | Chen | 312/221 |
| 2003/0141790 | A1 * | 7/2003 | Weng | 312/217 |
| 2007/0284976 | A1 * | 12/2007 | Huang | 312/220 |
| 2008/0074017 | A1 * | 3/2008 | Ruan et al. | 312/221 |
| 2008/0106175 | A1 * | 5/2008 | Huang | 312/217 |
| 2011/0127889 | A1 * | 6/2011 | Ludwig et al. | 312/220 |

* cited by examiner

*Primary Examiner* — Daniel Rohrhoff
(74) *Attorney, Agent, or Firm* — Squire Sanders (US) LLP

(57) ABSTRACT

An anti-tip lock assembly for a storage compartment includes a pair of geared actuators mounted on a base abutting against a follower. The follower and the base are configured to travel a limited distance along a vertical track installed in a storage unit. When the compartment is closed, the actuators are aligned with the track. When the compartment is opened, the actuators are moved out of alignment to block access to the moving components of the assembly. When the anti-tip lock assembly is operational, the array of like anti-tip assemblies in the track allow displacement of only one pair of actuators to occupy the limited distance at one time. A security bar array interacts with the actuators and other assemblies in the storage unit, to prevent simultaneous opening of two or more compartments. The security bar is provided with the track to lock and unlock the assembly.

30 Claims, 16 Drawing Sheets

~ 20 ~
2
3a
5
4
7
1
15
10
16
12a
9
8
11a
18a
12b
3b
18b
11b
17

TAMPER RESISTANT MODULAR ANTI-TIP LOCKING SYSTEM

FIELD OF THE INVENTION

The invention relates to anti-tip locking systems in multi compartment storage units. The invention may be used in various storage units including, but not limited to, office furniture, storage cabinets, filing cabinets, and many other examples of storage units having two or more storage compartments positioned in an array, and particularly those units which may topple if two or more compartments are opened simultaneously.

BACKGROUND

Typically, anti-tip systems have been plagued with compatibility problems, operational limitations, difficulties with installation and repairs, security issues caused by user tampering or vandalism, and a variety of other problems when combined with previously known locking systems.

It is therefore desirable to provide an anti-tip locking system which addresses a variety of these issues.

SUMMARY OF THE INVENTION

The invention includes an anti-tip assembly, a modular anti-tip mechanism which may be applied in OEM and retrofit applications, a lock assembly which may be used in various structures including filing cabinets, office furniture and a variety of other storage units having multiple storage compartments. Other embodiments will also become apparent to those skilled in the art upon reading the examples described herein.

Most often, such storage units have multiple compartments, such as drawers, for example, stacked and aligned vertically, usually to provide lightweight, space saving structures. However, such structures could be prone to tipping and falling if more than one drawer (or other type of compartment) would be allowed to open simultaneously with one or more other drawers within the storage units.

The invention may also be used in other installations within storage structures which may not be prone to tipping or upset. However, in some structures, the anti-tip locking system may be desirable to provide an alternative solution for preventing the simultaneous opening of two or more storage compartments even if tipping or upset is not a concern.

In one embodiment of the invention, an anti-tip assembly is provided for use in a storage unit comprising a plurality of storage compartments, with the compartments being in abutting relation. The storage unit defines a predetermined travel distance for the anti-tip assembly and all other, similar anti-tip assemblies, provided in the storage unit. The anti-tip assembly comprises the following components which operate as follows, when in use.

A base moves along a track between a first position and a second position. The first and second position define a separation distance equal to the predetermined travel distance.

A follower is positioned adjacent the base and the follower moves along the track between the first position and the second position.

A first actuator and a second actuator operate on the base. In some embodiments, the actuators rotate on axles extending from the base. The actuators operate in synchronized movement between an aligned position and a nonaligned position. In the aligned position, when an associated storage compartment is closed, the first and second actuators are in alignment with a common axis. In the non-aligned position, when the associated storage compartment is at least partially withdrawn, the actuators forms an acute angle with the common axis.

When the anti-tip assembly is in operation, an associated storage compartment is moved from a closed position to an open position. The first and second actuators move to the non-aligned position and the follower moves from the first position to the second position while the base is in the first position. The interaction of the components in the anti-tip assembly (with other anti-tip assemblies in the storage unit) inhibit opening of the other storage compartments in the storage unit, thus allowing only one compartment to open at one time.

When the first and second actuators are in the non aligned position, one of the actuators is positioned in close proximity to the inside wall of the storage unit and/or a drawer slide supporting the associated storage compartment, to inhibit realignment of the actuators when the associated drawer is at least partially opened. Preferably, the actuator, which is positioned in close proximity to the drawer slide (or an edge of the storage compartment), is configured and designed for movement so that it does not contact or rub against the drawer slide or the inside of the storage unit during operation of the storage compartment (since regular contact and/or rubbing may require lubrication and increased maintenance to inhibit wear, seizure or sticking, or possible failure).

When a storage compartment (other than the first storage compartment) is moved from a closed position to an open position, the follower and the base associated with the first storage compartment move together from a first base position to a second base position. The displacement of the follower and the base is equal to the displacement distance.

In one aspect, the anti-tip assembly includes a first bar segment and a second bar segment which move along the track. The first bar segment abuts against the follower, opposite the base, and the second bar segment abuts against the base, opposite the follower. When the associated compartment is closed, but another compartment in the storage unit is opened, the similar anti-tip assembly associated with the other compartment expands to occupy the space provided in the track, the space being equal to the predetermined distance.

Preferably, the track is mounted vertically on an interior wall of the storage unit. In some embodiments, the track may be manufactured as segments in predetermined lengths for each corresponding anti-tip assembly, so that two or more segments (and their corresponding assembly components) may be easily aligned and connected to form a longer operational track for the array of anti-tip assemblies. Although multiple assemblies and track segments may be combined, only one space equal to the displacement distance will be provided within the larger array once it is installed.

In another embodiment, a modular anti-tip assembly is provided for use in a storage unit comprising a plurality of storage compartments. The modular anti-tip assembly may comprise the following elements.

A first actuator is mounted on a base. The first actuator operates between a first position and a second position. In the first position, an associated storage compartment is closed, and in the second position, the associated storage compartment is open.

A second actuator is mounted on the base. The base is configured to operate along a track. The second actuator is synchronized for coordinated movement along with the first actuator when the anti-tip assembly operates between the first position and the second position. The movement of the first and second actuators may be synchronized by providing matched, interacting meshed gears (or other interactive features) on the first and second actuators.

In the first position, the first actuator and the second actuator are aligned with a common axis. Preferably, when the actuators are aligned with the common axis, the actuators may be easily locked and unlocked by displacing the corresponding assembly along the common axis, by a distance equal to the displacement distance. When the actuators are in the second position, the first actuator and the second actuator each form an acute angle with the common axis. Preferably, also, when the actuators are in the second position, each forming an acute angle, the actuators prevent access to the moving parts of the anti-tip assembly from the exterior of the storage unit when the associated compartment is opened.

A follower is positioned adjacent to the base. The follower and the base are both configured to operate along the track. When in use, the follower moves away from the base, from a first follower position to a second follower position, when the associated compartment is open, to prevent opening of other storage compartments in the storage unit.

In another embodiment of the invention, an anti-tip assembly is provided for use in an array of anti-tip assemblies within a storage unit. The anti-tip assembly is associated with a storage compartment in the storage unit. Every other storage compartment is associated with a similar anti-tip assembly. In this embodiment, the anti-tip assembly comprises the following elements.

When in use, a base operates between a first base position and a second base position. The first base position and the second base position define a separation distance along a longitudinal axis.

A follower is provided adjacent to the base, for operation between the first base position and the second base position.

A first actuator and a second actuator are mounted on the base, for synchronized movement between an aligned position along the longitudinal axis and a non-aligned position in which the first and second actuators are offset from the longitudinal axis.

When the associated storage compartment is moved from a closed position to an open position, the first and second actuators move to the non-aligned position, and the follower moves from the first position to the second position while the base remains in the first position. The opening of one or more other storage compartments in the storage unit is inhibited by displacing all of the other, similar anti-tip assemblies (located on the follower side of the activated anti-tip assembly) in the storage unit, across a displacement distance equal to the separation distance.

Preferably, the storage compartment is opened by withdrawing the storage compartment along a second axis which is perpendicular to the common axis defined by the track.

A lock assembly is also provided, which comprises an embodiment of the anti-tip assembly for use in a storage unit in association with an array of similar anti-tip assemblies, all in abutting relation, for limited movement along the track. For example, only one anti-tip assembly is permitted to expand to occupy a space equal to the separation distance.

In another embodiment, the lock assembly may include the following elements. An array of bar segments may be provided for blocking the storage compartments in the storage unit when the array of similar anti-tip assemblies are positioned so that each associated follower and each associated base are in their respective first positions.

A security bar may also be provided to lock all of the anti-tip assemblies, and their associated storage compartments, in a locked position. The security bar may be mounted by or on the track, for convenient assembly and for optimal space utilization. Preferably, the security bar locks and unlocks the assemblies (and their associated drawers) by movement along the track, to close the space corresponding to the separation distance. In other embodiments, the track may be an integral feature defined by the security bar.

A stop may be provided on the follower or on the base of an anti-tip assembly associated with a storage compartment. The stop engages a retainer associated with the storage compartment, to prevent withdrawal of the storage compartment when the security bar is in a locked position. The other storage compartments and their associated stops are provided with similar features to operate in a corresponding manner. In a preferred embodiment, a pair of opposing, offset stops are provided on the side wall of the storage compartment, to engage opposing sides of either the first or second actuator.

The invention also includes storage units which comprise a lock assembly as described herein. In one embodiment, a storage unit comprises a lock assembly with a security bar for locking the storage compartments in the storage unit to prevent withdrawal of the storage compartments when the security bar is in the locked position.

In other embodiments, an optional locking bar may be provided parallel to the security bar, on the opposite side of the array of storage compartments.

Other embodiments of the invention will become apparent to those persons who are skilled in the art upon reading the following detailed description, drawings and appended claims.

IN THE DRAWINGS

FIG. 1 is an exploded view of a first embodiment of an anti-tip locking assembly of the present invention;

FIG. 1*a* is a partial sectional side view of the anti-tip locking assembly of FIG. 1, in a locked position, installed in a storage unit;

FIG. 1*b* is another partial sectional side view of the anti-tip locking assembly of FIG. 1, and an enlarged partial side view the crank arm, in a unlocked position, installed in a storage unit;

Figure 11:
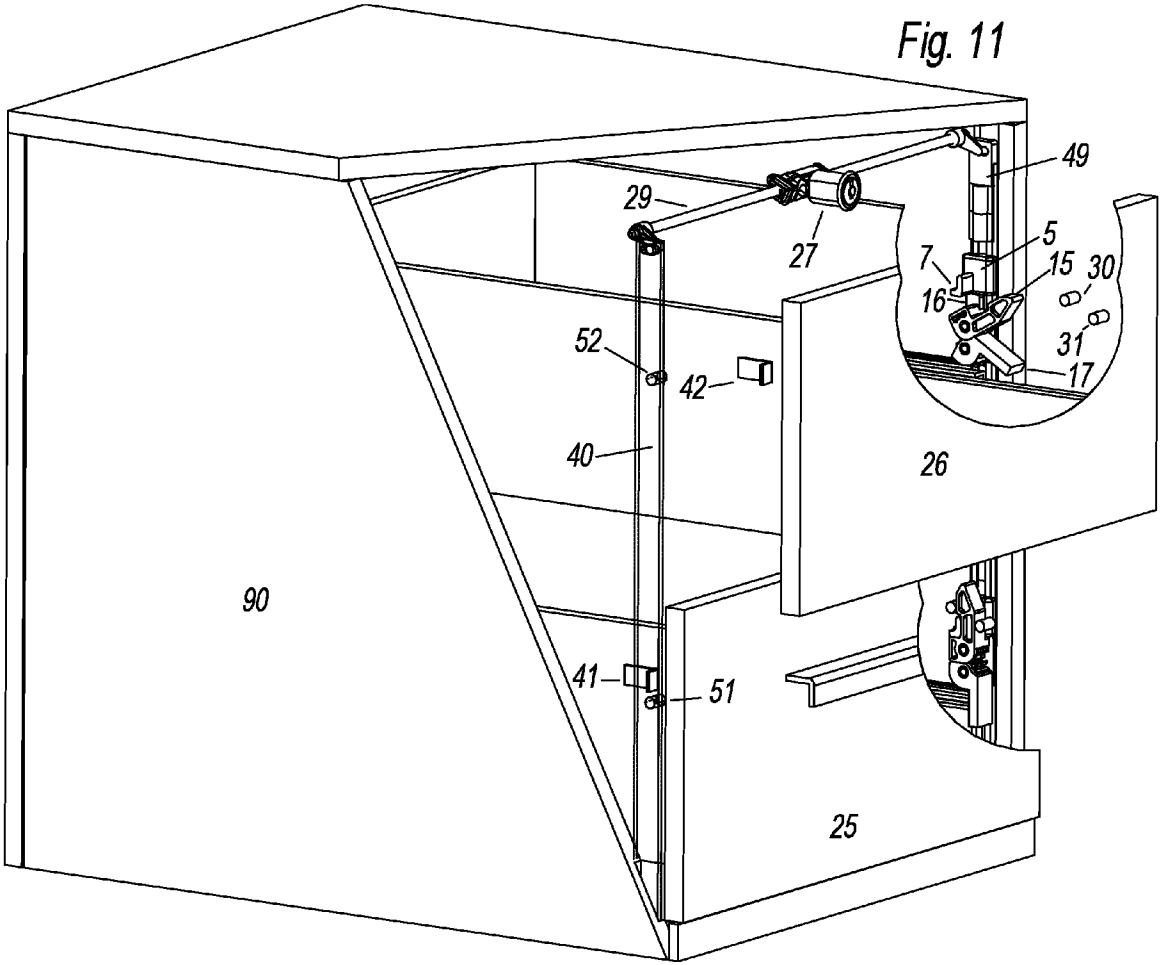
FIG. 11 is a partial sectional view in perspective of the storage unit of FIGS. 8 to 10 in which the anti-tip locking system of the storage unit is in an unlocked position, the upper associated drawer is partially opened and the associated anti-tip assembly is fully activated.
Figure 12:
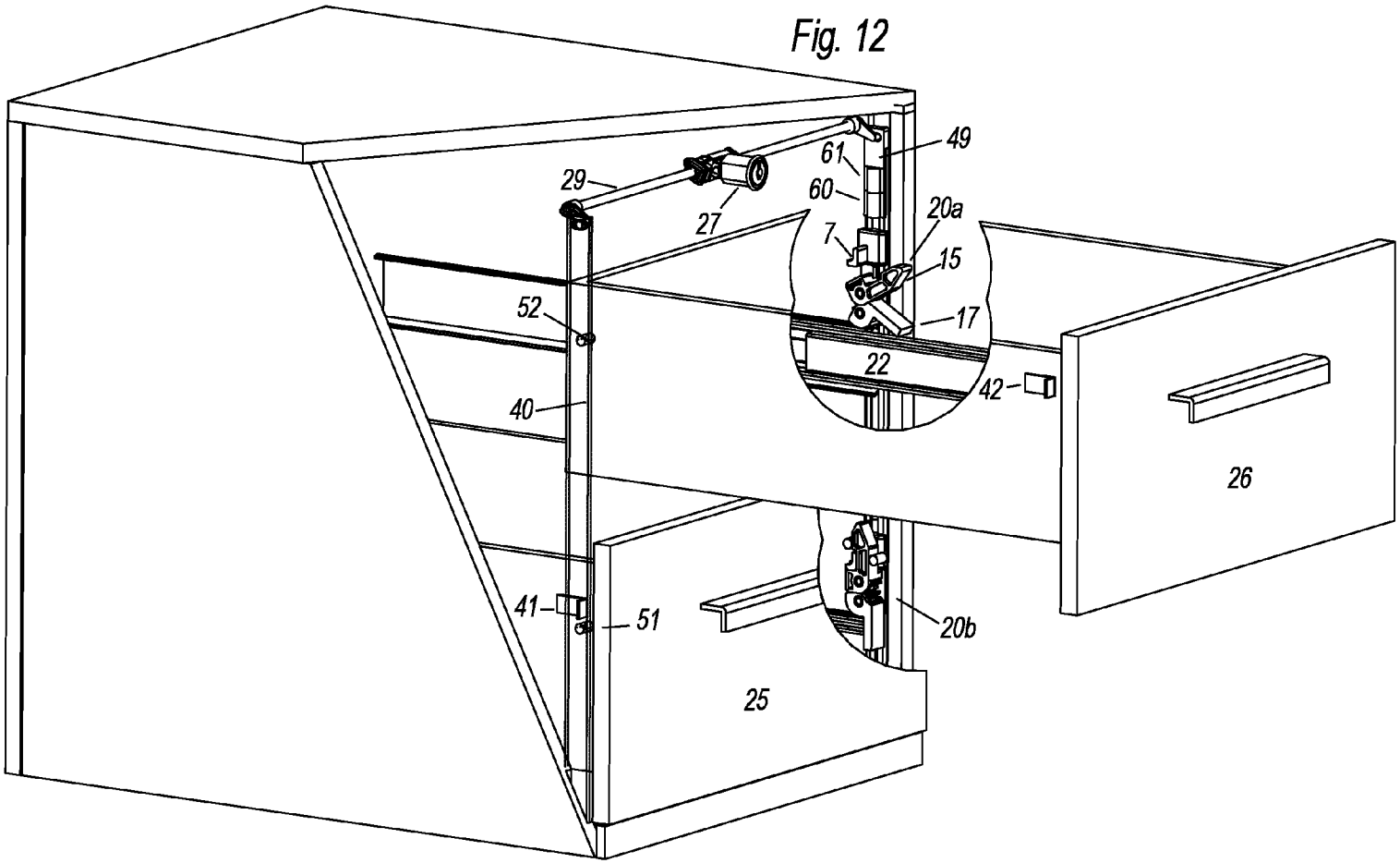
FIG. 12 is a partial sectional view in perspective of the storage unit of FIGS. 8 to 11 in which the anti-tip locking system of the storage unit is in an unlocked position, the upper associated drawer is fully opened and the associated anti-tip assembly is fully activated.
Figure 15:
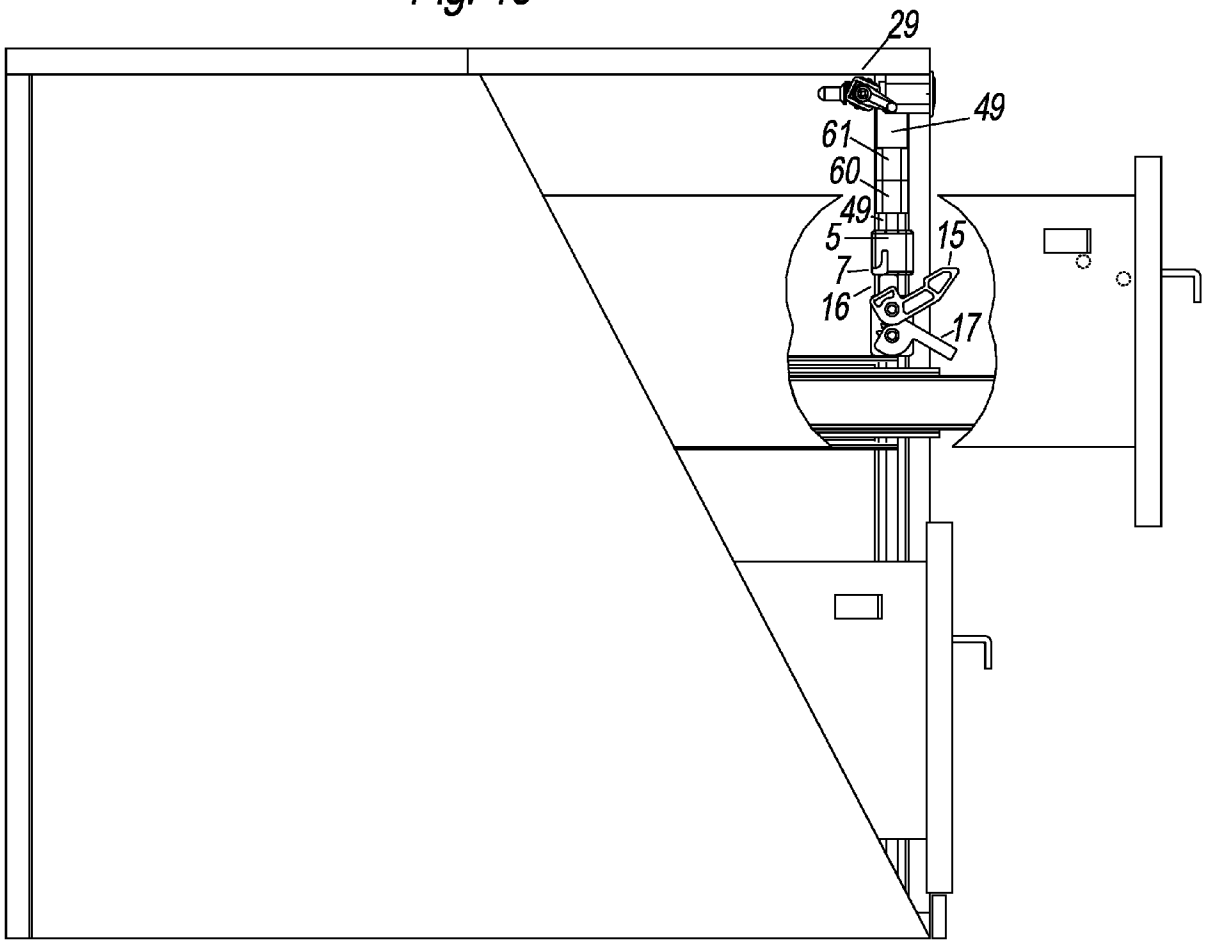
Figure 16:
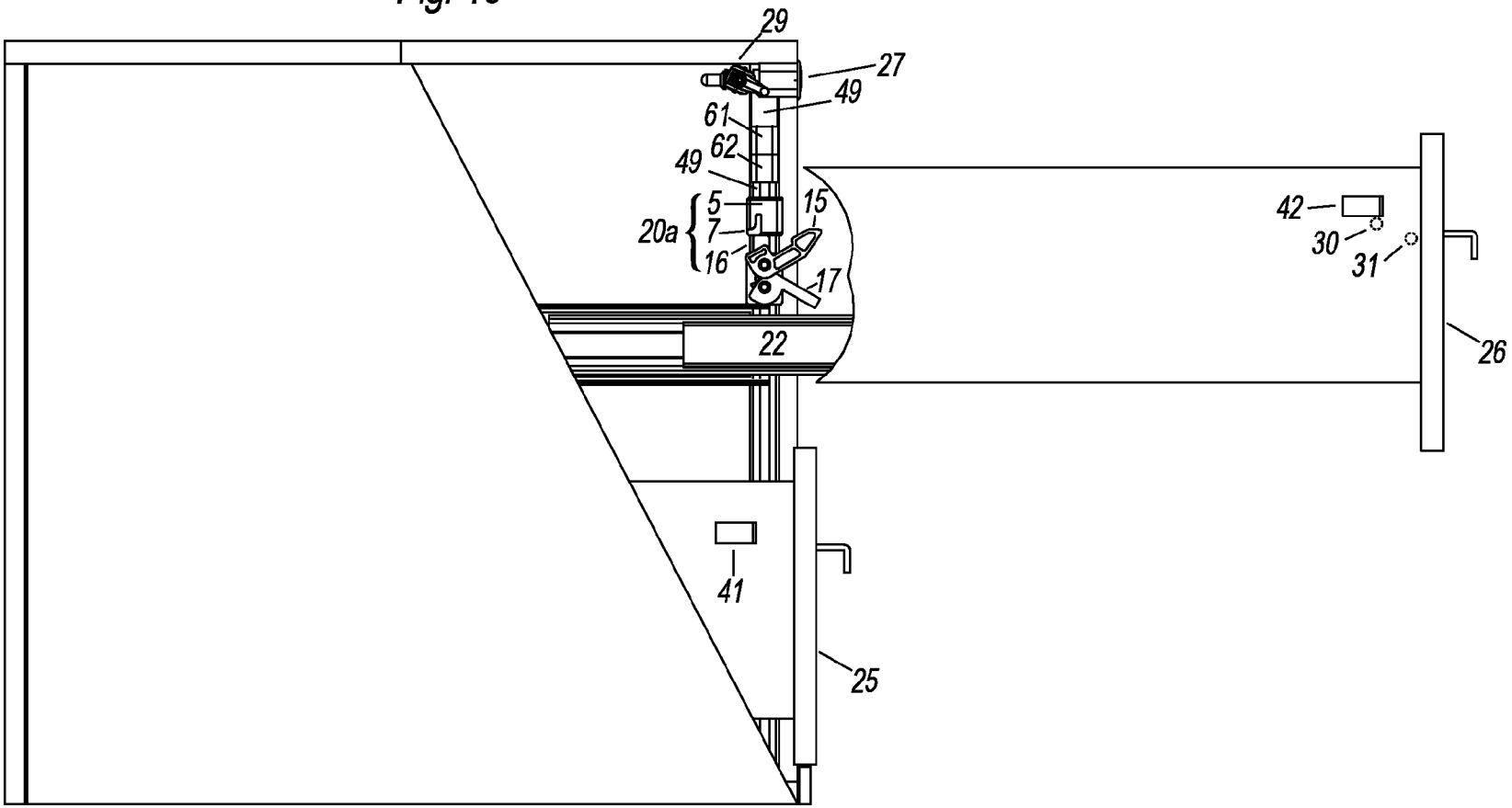

FIG. 15 is a partial sectional side view of the storage unit of FIG. 11 in which the anti-tip locking system of the storage unit is in an unlocked position, the upper associated drawer is partially opened and the associated anti-tip assembly is fully activated; and FIG. 16 is a partial sectional side view of the storage unit of FIG. 12 in which the anti-tip locking system of the storage unit is in an unlocked position, the upper associated drawer is fully opened and the associated anti-tip assembly is fully activated.

Other aspects of the invention will become apparent upon a review of the appended drawings and the following detailed description of a preferred embodiment of the invention.

DETAILED DESCRIPTION

Figure 1:
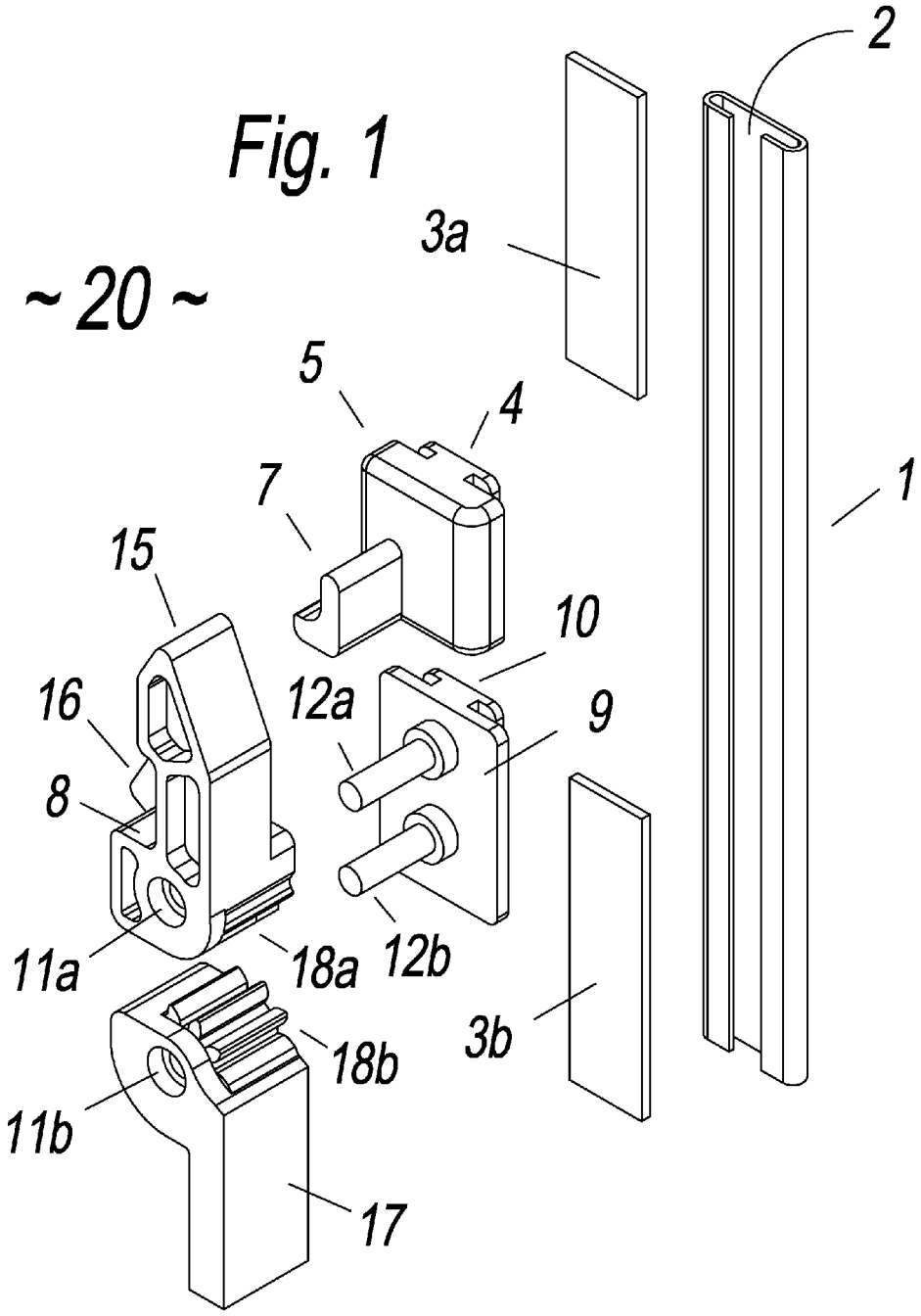
Figure 14:
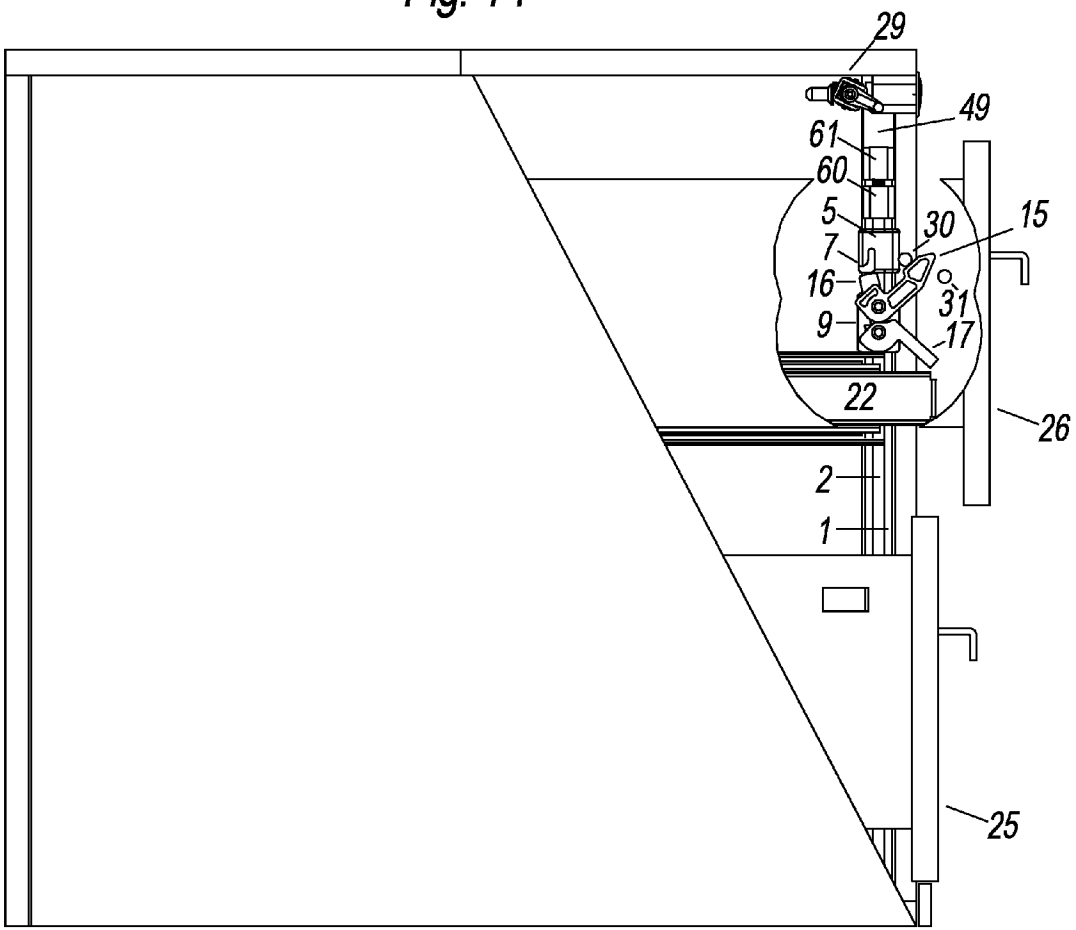
FIG. 14 is a partial sectional side view of the storage unit of FIG. 10 in which the anti-tip locking system of the storage unit is in an unlocked position, the upper associated drawer is being opened and the associated anti-tip assembly is partially activated.

FIG. 1 illustrates an exploded view of a preferred embodiment of an anti-tip assembly 20, showing a stackable track segment 1 having a C-shaped channel 2 configured to receive upper spacer bar segment 3*a*, T-shaped follower retainer 4 extending from follower 5, T-shaped base retainer 10 extending from base 9, and lower spacer bar segment 3*b* in abutting relation, when the components are assembled in stackable relation, within a security bar 49 illustrated in more detail in, for example, FIG. 14. One or more of these components may slide in an interactive manner within the track as described in greater detail below, during operation and use of the anti-tip assembly 20. In the preferred embodiment described and illustrated herein, the track is made as an assembly of assembled track segments 1, comprised of stacked track segments 1 and their corresponding anti-tip assembly components slid-fit within the channel of the track segments. Each anti-tip assembly is assigned to a corresponding drawer in a storage unit, stacked in abutting relation and supported by the security bar 49.

However, in another embodiment where the completed track is made in a single piece, the track segment 1 represents a notional sectional view of a larger, single unitary track feature in a security bar 49 (similar to the embodiment described in greater detail further below). In some instances, the security bar may be manufactured as a single piece including an integral track feature of a predetermined length which is sufficient to accommodate a predetermined number of anti-tip assemblies for a corresponding number of storage compartments.

In the preferred embodiment as illustrated, the track segment 1 (with its other associated anti-tip assembly components) is moved vertically during the locking and unlocking steps of the anti-tip assembly when installed for use in a storage unit. In various preferred embodiments, the upper and lower ends of the assembled C-shaped channel 2 supported by the single piece security bar 49 may be closed to define a unitary track assembly. The unitary track assembly may define a predetermined length sufficient to accommodate a predetermined number of similar anti-tip assemblies in abutting relation, for use with a corresponding number of drawers or other storage compartments.

Each track segment 1 is slide fitted with the other components of the anti-tip assembly, which include a pair of synchronously moving actuators adapted to interact with a corresponding storage compartment (in a linear array of compartments, which are typically, but not necessarily, stacked) in a storage unit so that only one drawer will open when the storage unit is unlocked. Follower 5 comprises a J-shaped restraint 7 which projects from the face of follower 5, to fit snugly within recess 8 of upper lever 15 when upper lever 15 and lower lever 17 are in longitudinal alignment with the longitudinal axis of track segment 1. Spacer 16 extends from upper lever 15, defining an acute angle with the longitudinal axis of upper lever 15.

Upper lever 15 and lower lever 17 are mounted on upper axle 12*a* and lower axle 12*b*, respectively. Upper axle 12*a* extends through bore 11*a* in upper lever 15, allowing upper lever 15 to rotate about upper axle 12*a*. Lower axle 12*b* extends through bore 11*b* in lower lever 17, allowing lower lever 17, to rotate about lower axle 12*b*. Upper gear 18*a* on upper lever 15 is engaged with lower gear 18*b*, for synchronized movement of the two levers 15,17 so that when the upper lever 15 is urged into rotational movement about upper axle 12*a*, the lower lever 17 is urged to rotate in a synchronized manner about lower axle 12*b*, by interactive movement of upper gear 18*a* and lower gear 18*b*.

Figure 2:
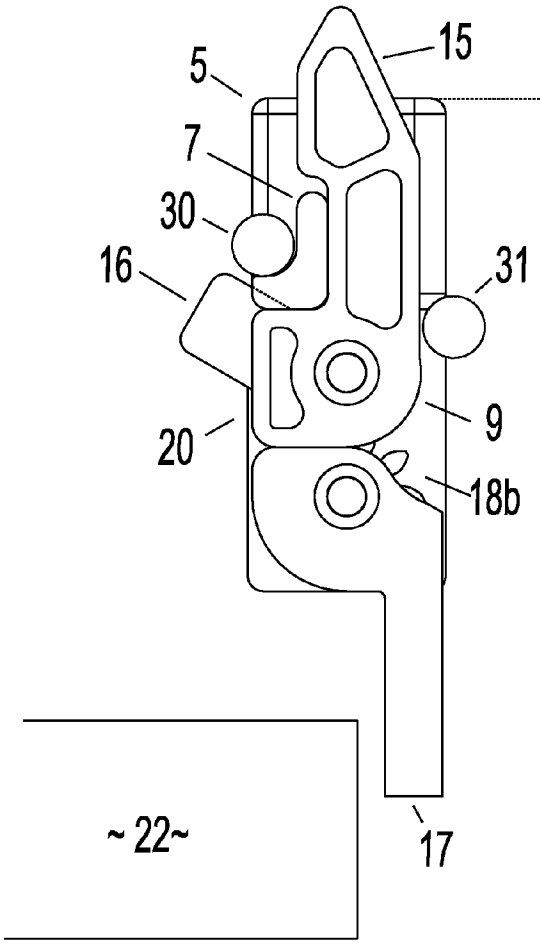
FIG. 2 is a side view of a partial sectional view of the first embodiment of the anti-tip assembly when in use, in which the assembly is fully locked and an associated drawer slide (shown in schematic) is closed.
Figure 6:
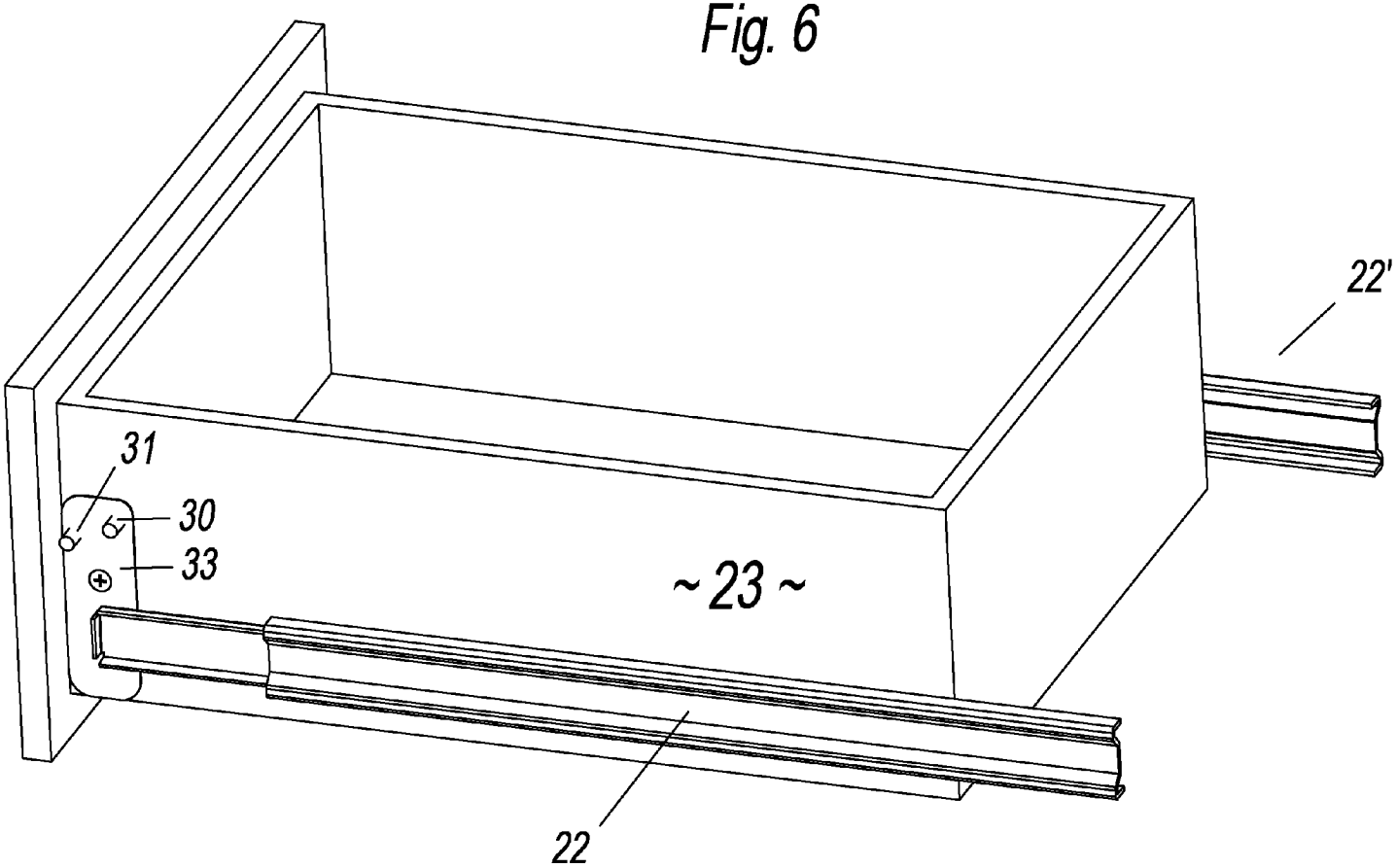
FIG. 6 is a side view in perspective of an example of an associated drawer configured to interact with the first embodiment of the invention.
Figure 7:
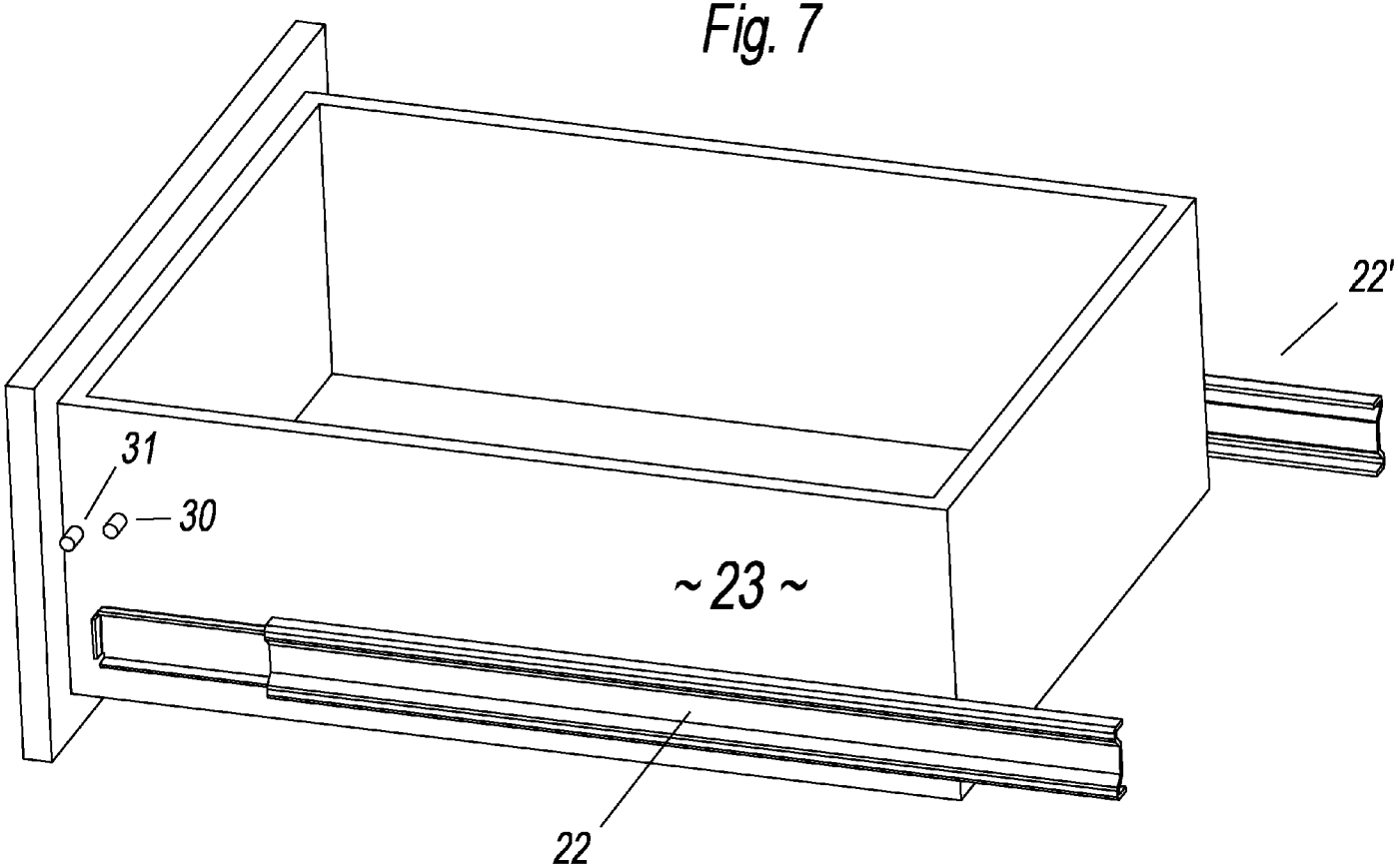
FIG. 7 is a side view in perspective of another example of an associated drawer configured to interact with the first embodiment of the invention.
Figure 8:
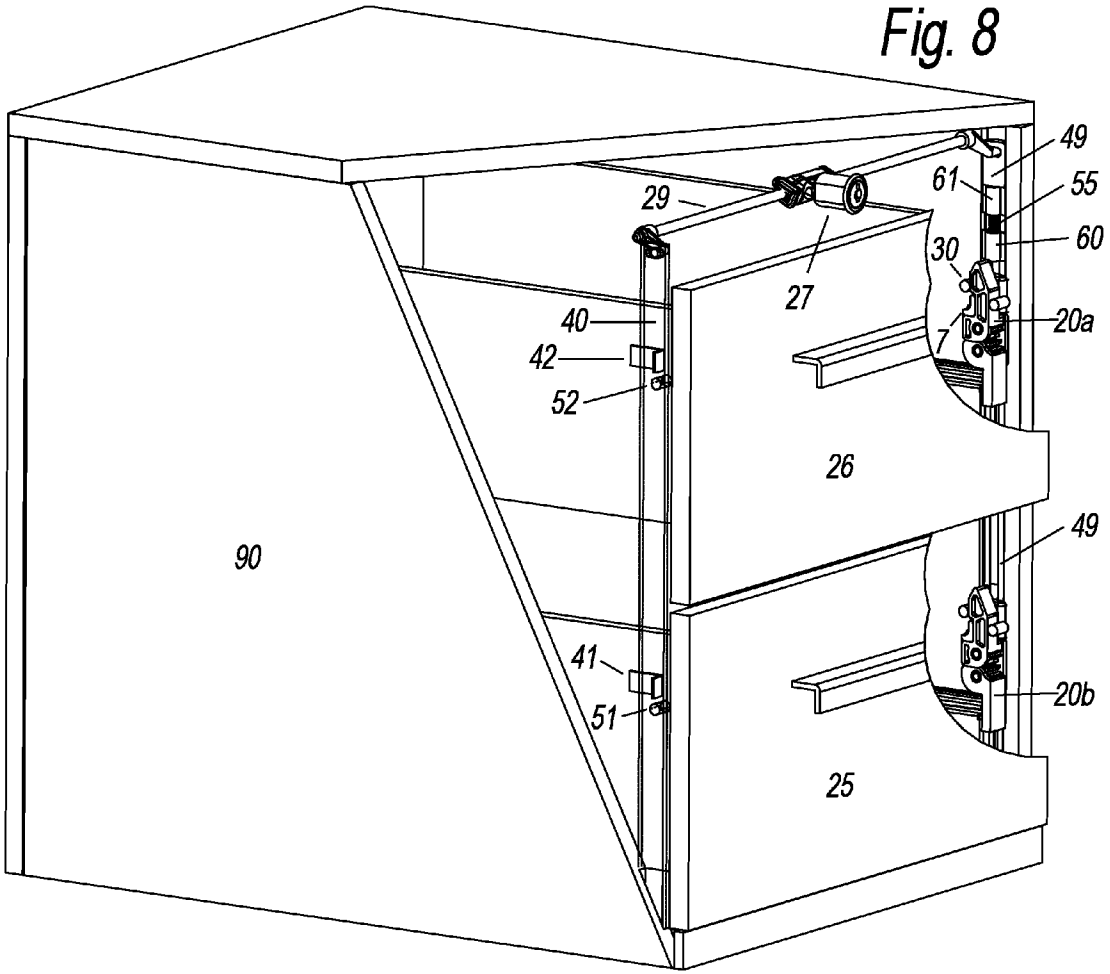
FIG. 8 is a partial sectional view in perspective of an embodiment of a storage unit having two vertically stacked drawers, each drawer being associated with the first embodiment of the anti-tip locking assembly, in an unlocked position, within the storage unit.
Figure 9:
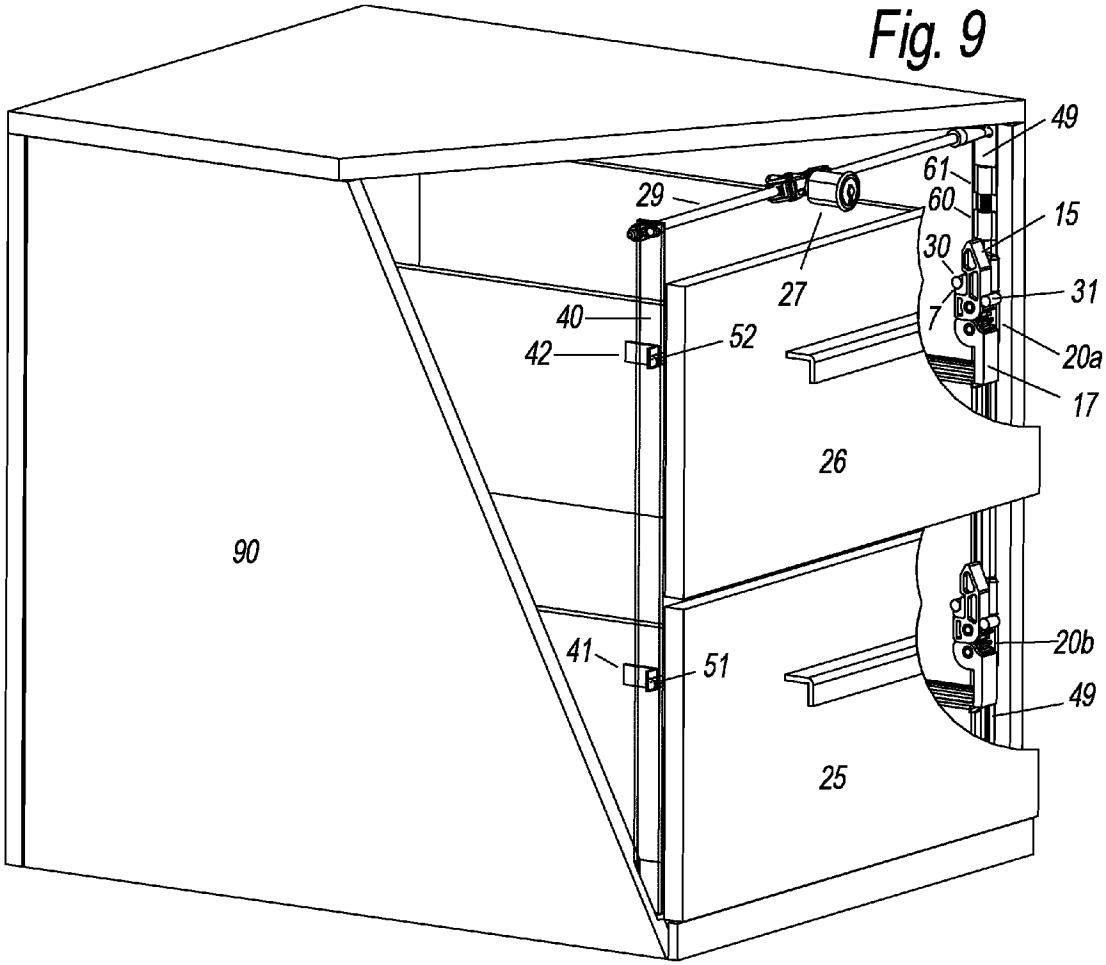
FIG. 9 is a partial sectional view in perspective of the storage unit of FIG. 8 in which the anti-tip locking system of the storage unit is in a locked position.

FIGS. 2-5 illustrate the various positions and interactions of the parts of the anti-tip assembly 20 when the locking system is locked and unlocked, and a drawer slide 22 is closed or opened. When lock bar 40 and security bar 49 are in the locked position, the locking assemblies 20*a* and 20*b* are stacked in an abutting, elevated orientation, as shown in FIG. 9. FIG. 2 shows similar locking assembly 20 in an elevated position (and the security bar 49 is elevated), when the drawer slide 22 is closed and the assembly 20 is locked (and elevated). Upper and lower levers 15, 17 are axially aligned with the longitudinal axis of the security bar 49 when the corresponding drawer slide 22 and the associated drawer 23 are closed. In the preferred embodiment, first activator pin 30 and second activator pin 31 extend from the drawer 23 as shown in FIGS. 6 and 7. In FIG. 6, the first and second activator pins 30,31, respectively, extend from a plate 33 affixed to the side drawer wall of a first embodiment of drawer 23, above drawer slide 22. Drawer 23 is mounted on a pair of opposed drawer slides 22, 22' so that the drawer 23 may be withdrawn from the storage unit when the locking system is unlocked. In the second embodiment of drawer 23 shown in FIG. 7, the first and second activator pins 30,31, respectively, are secured in another manner to extend directly from the side wall of that variant of drawer 23.

In FIG. 2, first activator pin 30 is engaged with j-shaped restraint 7 while second activator pin 31 abuts snugly against the opposite side wall of upper lever 15. Base 9 and follower 5 are in abutting relation, while spacer 16 extends outwardly away from the axis of the track (not shown). When the security bar 49 is in the locked position, vertical movement of the assembly 20 along the track (not shown) is prevented. Similarly, rotation of upper lever 15 (and synchronously engaged lower lever 17) is prevented, and outward movement of offset activator pins 30, 31 and affixed drawer 23, is prevented.

Figure 3:
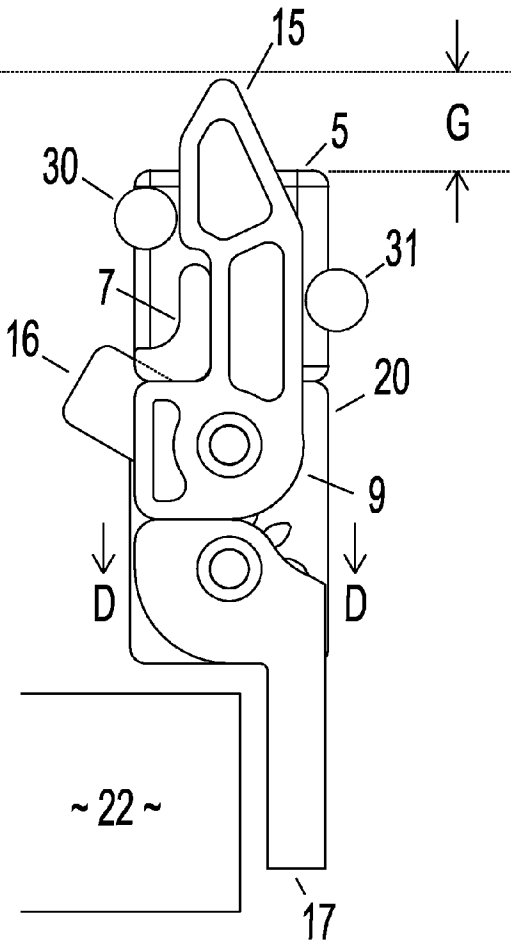
FIG. 3 is a side view of the first embodiment in which the anti-tip locking assembly has been unlocked, and the associated drawer slide (shown in schematic) is closed.

In FIG. 3, the locking system is unlocked, and the security bar 49 (and the locking bar 40) are lowered as shown by arrows D, thus allowing the entire anti-tip assembly 20 (and all similar associated assemblies in the storage unit) to move downwardly along the track (formed by a stacked array of corresponding number of track segments 1 and paired spacer bar segments 3*a*, 3*b*, in abutting position, positioned within security bar 49), a total displacement distance G. Drawer slide 22 is closed while the locking system is unlocked, in a position that would allow the opening and withdrawal of only one drawer in the vertical array of drawers in a storage unit. The downward displacement of the anti-tip assembly 20 disengages first activator pin 30 from j-shaped restraint 7. Second activator pin 31 is now positioned closer to the upper tip of upper lever 15.

Figure 5:
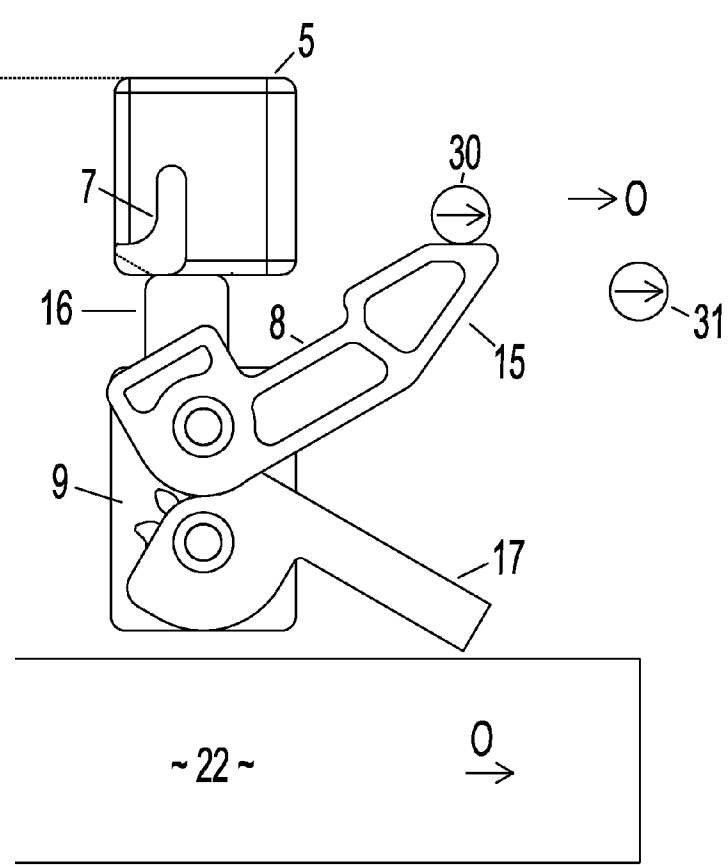
FIG. 5 is a side view of the first embodiment in which the anti-tip locking assembly is unlocked, with the associated drawer slide moving toward a fully opened compartment position, and the assembly is fully activated to prevent opening of other drawers (which are not shown)
Figure 4:
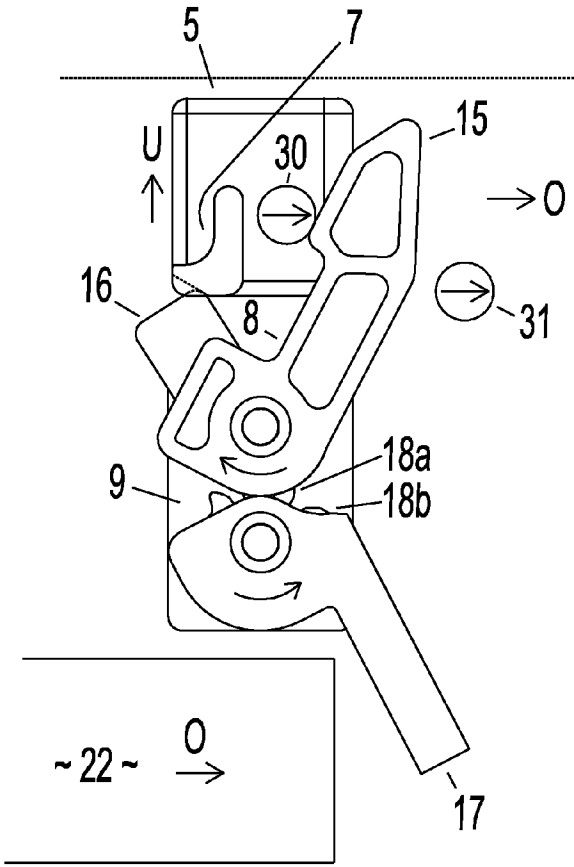
FIG. 4 is a side view of the first embodiment in which the anti-tip locking assembly is unlocked, the associated drawer slide is being opened during operation of the components of the assembly.

In FIGS. 4,5, drawer slide 22 is opened in direction O, outwardly away from the interior of the storage unit. As the drawer slide 22 is withdrawn, activator pin 30 on drawer 23 engages the upper tip of upper lever 15 (FIG. 4), causing the upper lever 15 and synchronously engaged lower lever 17 to rotate, away and out of alignment from the longitudinal axis of the track. As the drawer slide 22 and drawer 23 are withdrawn, spacer 16 engages follower 5, to separate the follower 5 from base 9. As the spacer 16 more fully engages follower 5 (as shown during the withdrawal sequence shown in FIGS. 4,5), the follower 5 moves upwardly in the direction shown by arrow U. When spacer 16 is in alignment with the longitudinal axis of the track (as shown in FIG. 5), follower 5 has been displaced upwardly by the displacement distance G. Actuator pin 30 clears the upper tip of upper lever 15, allowing the drawer 23 to be fully withdrawn.

Preferably, when drawer 23 is at least partially open, levers 15, 17 are in the non aligned position, and one of the levers (which in this illustrated example is lower lever 17) is positioned in close proximity to drawer slide 22 (supporting associated drawer 23) and/or a feature on an inside wall of the storage unit, to inhibit realignment of the levers 15, 17 when the associated drawer 23 and drawer slide 22 are at least partially opened. Preferably, lever 17, which is positioned in close proximity to the drawer slide 22 when drawer 23 is at least partially opened, is configured and designed for movement so that lever 17 does not contact or rub against the drawer slide 22 during operation of the drawer 23 (since regular contact and/or rubbing may require lubrication and increased maintenance to inhibit wear, seizure or sticking, or possible failure). Lever 17 is preferably configured so that it at least partially overhangs the proximate edge of drawer slide 22, to prevent realignment of the levers 15, 17 with the axis defined by the track. For example, if lever 17 were to be forcibly moved downwardly toward drawer slide 22, lever 17 would stop against the upper edge of drawer slide 22, thus preventing premature realignment of the levers 15, 17, before drawer 23 is returned to the fully closed position. It will be understood that one of the levers (in this case, lower lever 17) will be blocked against tampering or realignment that could lead to simultaneous opening of more than one drawer. Of course, other embodiments will be possible in which other drawer elements or features on the storage unit may be used to provide a stop or obstacle to premature realignment of the levers. For example, in some embodiments, the levers (or other actuator configurations) may be designed to interact with either drawer related components or with features provided on the storage unit, to inhibit premature closure of the levers before the drawer is returned to the closed position.

FIGS. 8-16 show an embodiment of a storage unit, in this example, a two drawer cabinet 90, in which an upper drawer 26 is positioned above lower drawer 25. Drawers 25, 26 are associated with corresponding lower anti-tip assembly 20*b* and upper anti-tip assembly 20*a*, respectively. When the lock 27 in this embodiment is unlocked, crank arm 29 is rotated from the locked position in FIG. 9 (and also shown in FIG. 1*a*), security bar 49 and the locking bar 40 are moved downwardly to the open position shown in FIG. 8 (and FIG. 1*b*). When locking bar 40 and security bar 49 are lowered, the end spacer bar segment 61 continues to be separated from paired bar segment 60, as compression spring 55 presses downwardly against bar segment 60, the abutting assemblies 20*b*, 20*a*, and the spacer bar segments 3*a*, 3*b* associated with those assemblies 20*a*, 20*b*, causing the end spacer bar segment 61, to remain separated by a displacement distance G.

Figure 1A:
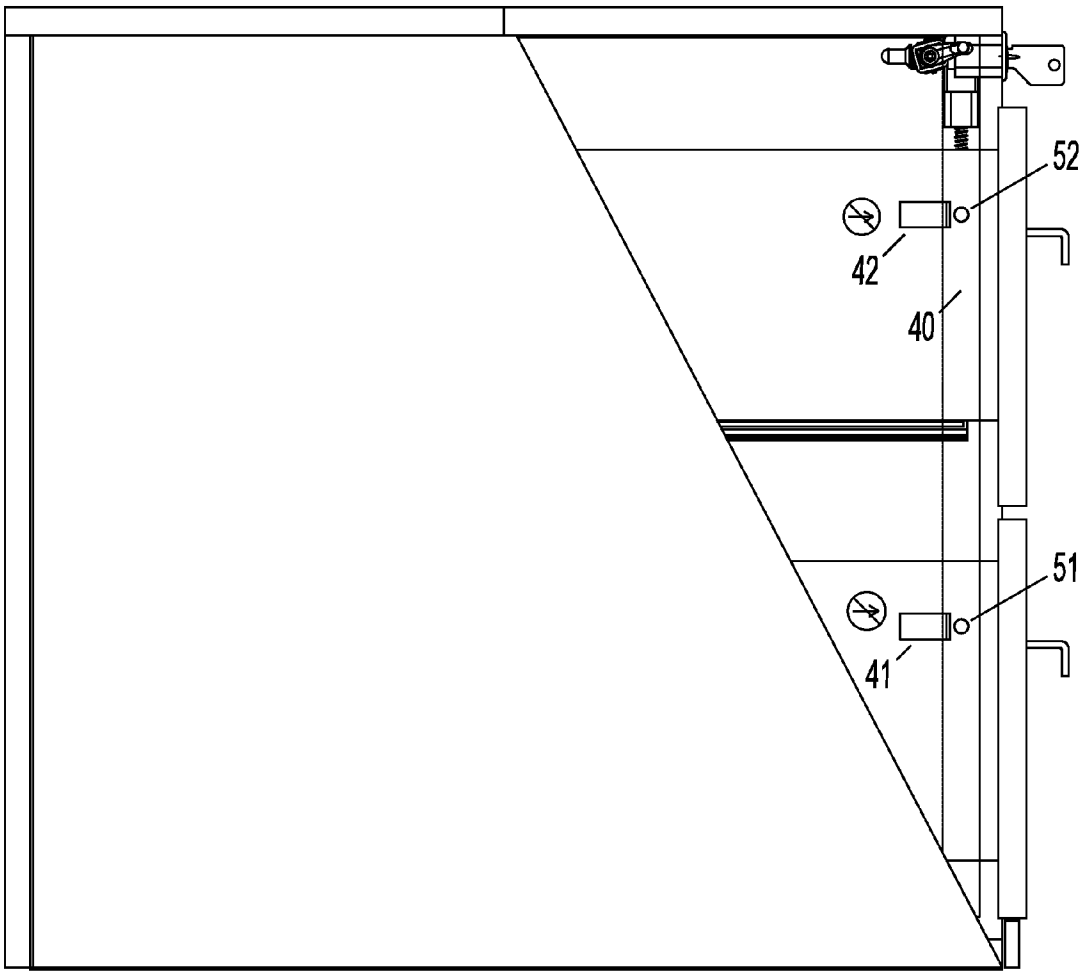
Figure 1B:
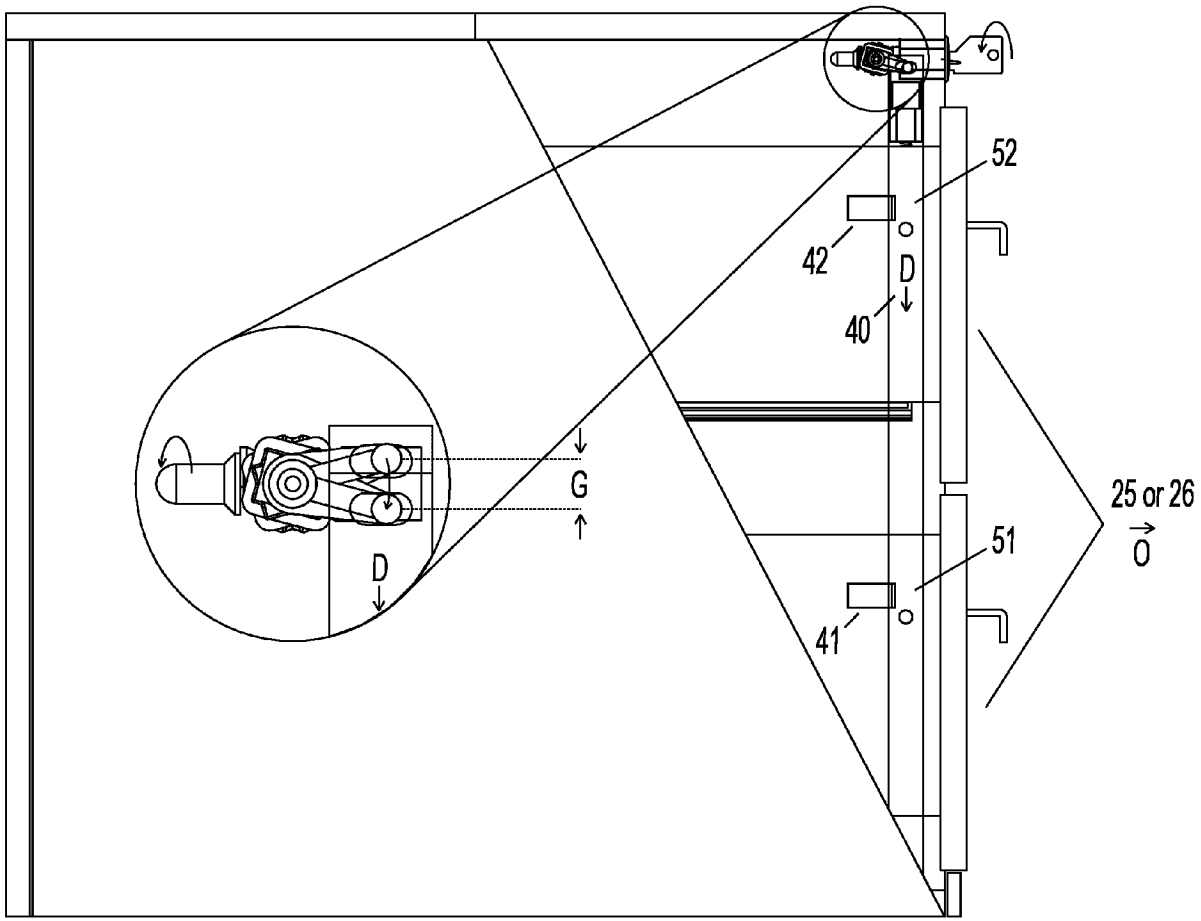

When the locking system is locked (as shown in FIGS. 9, 1*a*), optional locking bar 40 is positioned opposite and parallel to the security bar 49. Upper drawer pin 52 on locking bar 40 opposes upper trap 42 fixed to the side wall of upper drawer 26. Similarly, lower drawer pin 51, which is also fixed to locking bar 40, opposes lower trap 41 fixed to the side wall of lower drawer 25. As shown in FIG. 1*b* (and FIG. 8), when the locking bar 40 is lowered, in the direction shown by arrow D, through a displacement distance G, upper drawer pin 52 and lower pin 51 are moved out of alignment with upper trap 42 and lower trap 41, respectively, to allow either drawer 26 or 25 to be opened/withdrawn. In this preferred embodiment, locking bar 40 is an optional feature provided to enhance the locking system security, as an additional restraint acting on the second side of the vertical drawer array 25, 26 to inhibit withdrawal of any of the drawers.

Figure 10:
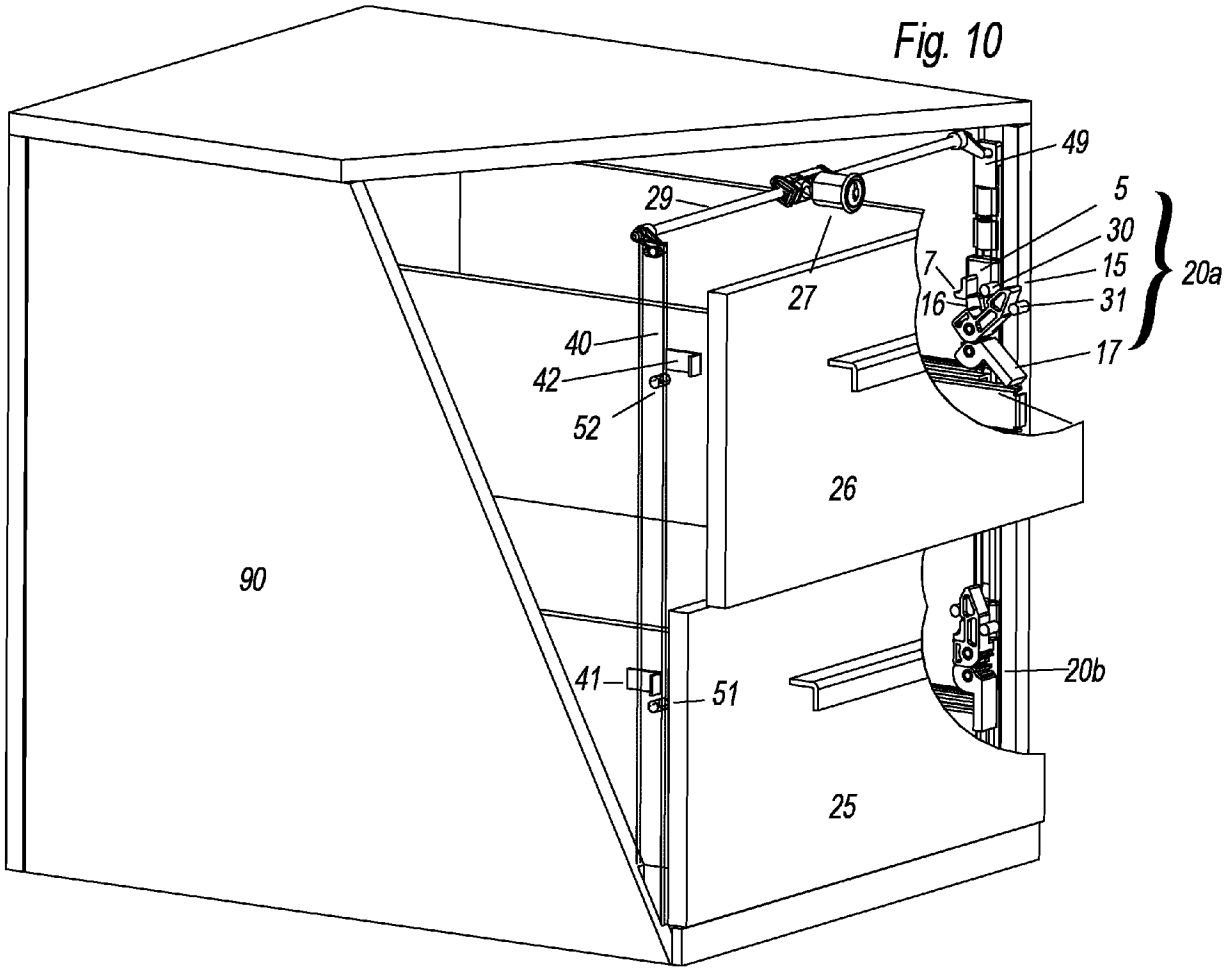
FIG. 10 is a partial sectional view in perspective of the storage unit of FIG. 8 and FIG. 9 in which the anti-tip locking system of the storage unit is in an unlocked position, the upper associated drawer is being opened and the associated anti-tip assembly is partially activated.

In FIG. 10 and FIG. 14, as the upper drawer 26 is partially withdrawn, upper anti-tip assembly 20*a* is partially displaced, by interaction between offset activator pin array 30,31, and synchronously interactive levers 15, 17, causing spacer 16 to rotate toward the track defined by security bar 49, to urge follower 5 to move upwardly, compressing spring 55 and urging spacer bar segment 60 toward end bar segment 61. As upper drawer 26 is withdrawn further, as shown in FIG. 11 and FIG. 15, follower 5, and spacer bar segment 60 are urged upwardly through the full displacement distance G, to fully compress spring 55 and abut against end bar segment 61, and to block the other drawer 25 in the array against withdrawal from the storage unit 90. The withdrawal sequence is completed when the drawer 26 is fully extended outwardly as shown in and FIGS. 12 and 16.

Spring 55 is provided to maintain the displacement distance G between segments 60, 61 when the drawers are closed, and the locking system is in the locked or unlocked position. When the system is unlocked, the security bar 49 is lowered, and the spring 55 urges the anti-tip assemblies to follow in a downward direction to maintain the separation distance G between segments 60,61. The spring 55 also acts to establish the preferred alignment of the levers 15,17 with activator pins 30,31 so that the levers 15,17 will properly interact with the activator pins 30,31 during opening and closing the associated drawer.

During manufacture, assembly or installation of the locking assembly, and the predetermined number of anti-tip assemblies, the lengths of one or both of the spacer bar segment 60 and the end bar segment 61 may be adjusted by cutting or grinding (or substitution with a larger piece if added length is required). The length of one or both segments may be adjusted to provide a snug, abutting relationship between the neighboring anti-tip assemblies. An adjustment may be required or desirable so that a suitable displacement distance G is provided within manufacturer tolerances and/or specifications, to avoid loose fitting components within the final array of like anti-tip assemblies. Accordingly, a well fitted locking assembly may be installed in a storage unit. Similarly, other features may be used as a substitute biasing feature in place of the compression spring 55 described in the preferred embodiment.

Figure 13:
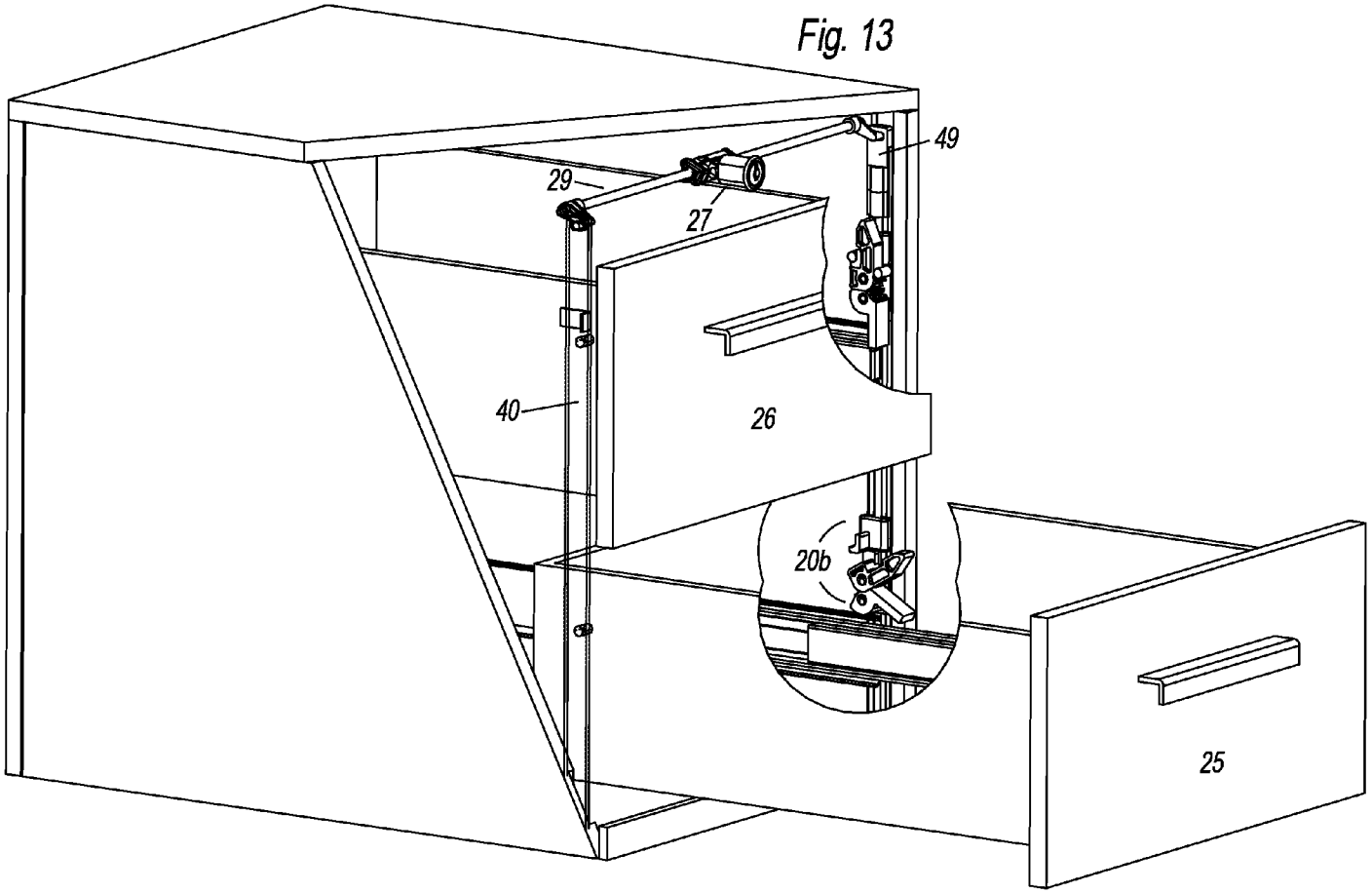
FIG. 13 is a partial sectional view in perspective of the storage unit of FIGS. 8 to 11 in which the anti-tip locking system of the storage unit is in an unlocked position, the lower associated drawer is fully opened and the associated anti-tip assembly is fully activated.

In FIG. 13, lower drawer 25 is shown fully withdrawn from the storage unit 90. The follower of the lower anti-tip assembly 20*b* is fully displaced upwardly along with its corresponding upper bar segment (which is similar to upper bar segment 3*a* shown in FIG. 1) and the abutting components of the upper anti-tip assembly 20*a*, along the track 1. Upper anti-tip assembly 20*a* and bar segment 60 have been displaced through the displacement distance G, to abut against end bar segment 61, to prevent upper drawer 26 from being withdrawn while drawer 25 is withdrawn in the fully opened position.

In some embodiments of the invention, the anti-tip assembly may be provided as a fully assembled kit or a partially assembled kit for installation in an OEM storage unit, or for retrofit installations in previously used storage units. A preferred kit may comprise the components of the anti-tip assembly illustrated in FIGS. 1-5.

Other embodiments of the invention will include locking assemblies comprising a lock, an actuator arm activated by the lock, and security bar with a suitable number of interactive anti-tip assemblies mounted in the security bar. In the illustrated embodiment, the key operated rotating lock 27 and crank arm 29 are an example of a preferred swivel crank arm mechanism described in U.S. Pat. No. 6,698,258. It will be appreciated that other locking actuator mechanisms may be adapted and used in association with the anti-tip assembly of the present invention.

The foregoing examples are illustrative of only some embodiments of the invention, including preferred embodiments of an anti-tip assembly, a locking system, and a storage unit or a storage structure including a preferred locking system. It will be apparent to those skilled in the art that additional embodiments and variations are possible and that such embodiments and variations will fall within the scope of the appended claims.

I claim:

1. An anti-tip assembly for use in a storage unit comprising a plurality of storage compartments in abutting relation, defining a predetermined travel distance, the anti-tip assembly comprising:

a base for movement along a track between a first position and a second position, the first and second position defining a separation distance equal to the predetermined travel distance, a follower adjacent the base, for movement along the track between the first position and the second position, a first actuator and a second actuator mounted on the base, operating in synchronized movement in the same direction, between an aligned position and a non-aligned position, in the aligned position, the first and second actuators are in alignment with a common axis, and in the non-aligned position, the first and second actuators each form an acute angle with the common axis, such that when an associated storage compartment is moved from a closed position to an open position, the first and second actuators move to the non-aligned position, and the follower moves from the first position to the second position, across the separation distance, while the base is in the first position, to inhibit opening of the other storage compartments in the storage unit.

2. In the anti-tip assembly claimed in claim 1, the movement of the first and second actuators is synchronized by an associated pair of meshed gears.

3. The anti-tip assembly claimed in claim 2, such that when a storage compartment other than the associated compartment moves from a closed position to an open position, the follower and the base move together from the first position to the second position, and the first and second actuators remain in the aligned position, to inhibit opening of the associated compartment in cooperation with other like anti-tip assemblies associated with the other compartments in the storage unit.

4. The anti-tip assembly claimed in claim 1 comprising:

a first spacer bar for movement along the track, abutting against the follower, a second spacer bar for movement along the track, abutting against the base when the associated compartment is closed and one of the other compartments in the storage unit is opened, and a like anti-tip assembly associated with the one of the other storage compartments in which a like follower moves away from an associated like base by a distance equal to the separation distance.

5. The anti-tip assembly claimed in claim 4 comprising the track, the track being configured for secure attachment along a vertical wall of the storage unit.

6. In the anti-tip assembly claimed in claim 5, the track being configured for aligned secure attachment with one or more like track segments associated with a corresponding one of more like anti-tip assemblies configured for secure attachment along a vertical wall of the storage unit.

7. A lock assembly comprising the anti-tip assembly claimed in claim 4 for use in the storage unit in association with an array of like anti-tip assemblies in abutting relation for movement along the track.

8. The lock assembly claimed in claim 7 comprising:

a security bar for locking the storage compartments in the storage unit when the array of like anti-tip assemblies are positioned such that each associated follower and each associated base are in their respective first position, and a stop defined in one of the each associated follower or one of the each associated base, the stop engaging an associated retainer to prevent withdrawal of the storage compartments when the security bar is in a locked position.

9. A storage unit comprising the lock assembly claimed in claim 7.

10. A storage unit comprising the lock assembly claimed in claim 7, the lock assembly comprising a security bar for locking the storage compartments in the storage unit to prevent withdrawal of the storage compartments when the security bar is in the locked position.

11. A modular anti-tip assembly for use in a storage unit comprising a plurality of storage compartments, the modular anti-tip assembly comprising:

a first actuator mounted on a base, the first actuator operating between a first position and a second position, a second actuator mounted on the base, the base configured to operate along a track, the second actuator synchronized with the first actuator for coordinated movement between the first position and the second position, in the first position, the first actuator and the second actuator being in alignment with a common axis while an associated storage compartment is closed, and in the second position, the first actuator and the second actuator each forming an acute angle with the common axis while the associated storage compartment is open, and, a follower adjacent to the base and configured to operate along the track, the follower moving away from the base, from a first follower position to a second follower position, when the associated compartment is open, to prevent opening of other storage compartments in the storage unit.

12. The modular anti-tip assembly claimed in claim 11, wherein the operation of the first and second actuators between the first position and the second position is synchronized by an associated pair of meshed gears, the associated pair of meshed gears comprising:

a first gear on the first actuator, and a second gear on the second actuator.

13. The modular anti-tip assembly claimed in claim 12, wherein the follower and the base move together from the first follower position to the second follower position, and the first and second actuators remain in alignment with the common axis, to inhibit opening of the associated compartment in cooperation with other like modular anti-tip assemblies associated with the other compartments in the storage unit.

14. A lock assembly for use in a storage unit comprising:

the modular anti-tip assembly claimed in claim 13 in association with an array of like anti-tip assemblies in abutting relation for movement along the track, one of the first and second actuators, when in the non-aligned position, is positioned adjacent an overlapping edge associated with said storage compartment or the storage unit, and the track being configured for secure attachment along a vertical wall of the storage unit along the track.

15. The lock assembly claimed in claim 14 comprising:

a security bar for locking the storage compartments in the storage unit when the array of like anti-tip assemblies are positioned such that each associated follower and each associated base are in their respective first position, and a stop defined in one of the each associated follower or one of the each associated base, the stop engaging an associated retainer to prevent withdrawal of a corresponding one of the storage compartments when the security bar is in a locked position, each associated retainer being secured for movement along with the corresponding one of the storage containers.

16. The lock assembly claimed in claim 15, comprising an array of spacer bar segments associated with each of the modular anti-tip assemblies in the array of like anti-tip assemblies, each spacer bar segment in the array of spacer bar segments being configured for movement along the track, such that only one follower in one of the modular anti-tip assemblies is permitted to move from the first position to the second position when the lock assembly is in an unlocked position.

17. A storage unit comprising the lock assembly claimed in claim 16.

18. In the storage unit comprising the lock assembly claimed in claim 16, the modular anti-tip assembly and the array of like anti-tip assemblies being configured to engage a linear array of restraints positioned on each of the storage compartments in the storage unit to inhibit withdrawal of the storage compartments when the array of spacer bar segments is in the locked position.

19. A lock assembly comprising:

the modular anti-tip assembly claimed in claim 14 for use in the storage unit in association with the array of like anti-tip assemblies in abutting relation for movement along the track, a spacer bar array, operating along the track, for moving the anti-tip assembly between the first position and the second position, and a security bar, operating along the track, for moving the anti-tip assembly between the locked position and the unlocked position.

20. The modular anti-tip assembly claimed in claim 11 defining a predetermined travel distance between the first position and the second position, one of the first and second actuators, when in the non-aligned position, is positioned adjacent an overlapping edge associated with said storage compartment or the storage unit, and the assembly comprising:

the track, a first spacer bar for movement along the track, with the follower, a second spacer bar for movement along the track, with the base, such that when the associated compartment is closed and one of the other compartments in the storage unit is opened, a like follower, in a like modular anti-tip assembly associated with the one of the other storage compartments, moves away from an associated like base by a distance equal to the predetermined travel distance.

21. In the modular anti-tip assembly claimed in claim 20, the track being configured for secure attachment along a vertical wall of the storage unit.

22. The modular anti-tip assembly claimed in claim 21 wherein the track is configured as a segment for aligned secure attachment with one or more like track segments associated with a corresponding one of more like anti-tip assemblies along the vertical wall of the storage unit.

23. The modular anti-tip assembly claimed in claim 11 configured to operate between a locked position and an unlocked position by moving vertically in a first direction, and to allow the storage compartment to operate horizontally between the open position and the closed position.

24. In the modular anti-tip assembly claimed in claim 11, the follower engages the first actuator when the first actuator is in the first position.

25. In the modular anti-tip assembly claimed in claim 24, the follower is configured to engage the associated storage compartment when the modular anti-tip assembly is in a locked position, and the first actuator is operable between the first position and the second position when the follower is disengaged from the associated storage compartment.

26. An anti-tip assembly for use in an array of anti-tip assemblies, in association with a storage compartment in a storage unit, the anti-tip assembly comprising:

a base for operation between a first position and a second position, the first position and the second position defining a separation distance along a longitudinal axis, a follower adjacent the base, for operation between the first position and the second position, a first actuator and a second actuator mounted on the base, for synchronized movement between an aligned position along the longitudinal axis and a non-aligned position in which the first and second actuators are offset from the longitudinal axis, one of the first and second actuators, when in the non-aligned position, is positioned adjacent an overlapping edge associated with said storage compartment or the storage unit, such that when the associated storage compartment is moved from a closed position to an open position, the first and second actuators move to the non-aligned position, and the follower moves from the first position to the second position while the base is in the first position, to inhibit opening of one or more other storage compartments in the storage unit.

27. The anti-tip assembly claimed in claim 26, comprising:

a track defining the longitudinal axis, the base and the follower being configured to travel along the track, a spacer bar array, operating along the track, for moving the anti-tip assembly between the first position and the second position, and a security bar, operating along the track, for moving the anti-tip assembly between a locked position and an unlocked position.

28. In the anti-tip assembly claimed in claim 27, the first actuator is configured to lockably engage the storage compartment or the follower when the anti-tip assembly is in the locked position.

29. In the anti-tip assembly claimed in claim 28, when the anti-tip assembly is moved to the unlocked position, the anti-tip assembly is configured to allow displacement of the storage compartment along a second axis perpendicular to the longitudinal axis.

30. In the anti-tip assembly claimed in claim 29, the security bar operating vertically to unlock the anti-tip assembly by disengaging the first actuator from:

a first restraint on the storage compartment, and a second restraint on the follower.

* * * * *